US011127548B1

(12) United States Patent
Liang et al.

(10) Patent No.: US 11,127,548 B1
(45) Date of Patent: Sep. 21, 2021

(54) KEYBOARD AND METHOD FOR ASSEMBLING THEREOF

(71) Applicant: LITE-ON Technology (Chang Zhou) Co., LTD., Jiangsu Province (CN)

(72) Inventors: XiaoQiang Liang, Jiangsu Province (CN); Lei Shi, Jiangsu Province (CN); HongGen Zhu, Jiangsu Province (CN)

(73) Assignee: LITE-ON Technology (Chang Zhou) Co., LTD., Jiangsu Province (CN)

( * ) Notice: Subject to any disclaimer, the term of this patent is extended or adjusted under 35 U.S.C. 154(b) by 0 days.

(21) Appl. No.: 16/896,999

(22) Filed: Jun. 9, 2020

(51) Int. Cl.
*H01H 13/86* (2006.01)
*H01H 13/88* (2006.01)
*H01H 13/79* (2006.01)

(52) U.S. Cl.
CPC ..... *H01H 13/88* (2013.01); *H01H 13/79* (2013.01); *H01H 13/86* (2013.01)

(58) Field of Classification Search
CPC ..... H01H 13/88; H01H 13/79; H01H 13/86; H01H 13/10; H01H 13/14; H01H 2233/07; H01H 13/705; H01H 3/125; H01H 13/04; H01H 13/20; H01H 2223/034; H01H 2233/002; H01H 2239/032; H01H 2223/056; H01H 2233/01; H01H 36/0033
See application file for complete search history.

(56) References Cited

U.S. PATENT DOCUMENTS

2014/0218890 A1* 8/2014 Wang ..... G02B 6/0055 362/23.03

* cited by examiner

*Primary Examiner* — Ahmed M Saeed
(74) *Attorney, Agent, or Firm* — Umberg Zipser LLP; Ryan Dean

(57) ABSTRACT

A keyboard and a method for assembling the keyboard are provided. The keyboard comprises a keyswitch module, a keyboard frame, and a plurality of connecting parts. The keyswitch module comprises a baseplate, a circuit board, and a plurality of keyswitch groups. The circuit board is disposed on the baseplate. The plurality of the keyswitch groups is disposed on the circuit board. The baseplate comprises a plurality of connecting holes. The circuit board comprises a plurality of through holes. The plurality of connecting holes respectively corresponds to the plurality of through holes. The keyboard frame is disposed on the keyswitch module, comprising a plurality of keyswitch holes. The plurality of the keyswitch groups is respectively disposed in the corresponding keyswitch holes. The connecting parts are respectively filled in the corresponding connecting holes, connecting to a surface of the keyboard frame close to the circuit board through the corresponding through holes.

9 Claims, 16 Drawing Sheets

KEYBOARD AND METHOD FOR ASSEMBLING THEREOF

CROSS REFERENCE TO RELATED APPLICATION

This application claims the priority benefit of Chinese Patent Application Serial Number CN202010307333.4, filed on Apr. 17, 2020, the full disclosure of which is incorporated herein by reference.

BACKGROUND

Technical Field

The present disclosure relates to the technical field of keyboard and keyboard manufacturing, particularly to a keyboard and a method for assembling the keyboard.

Related Art

Conventional computer keyboards are mostly assembled by hot-melting, screwing, or riveting in which the screw assembling often brings problems such as poor screwing, stripping, and short circuit caused by loosening screws which fall into computer since the method requires a large number of well-built screws, and precise operated assembling tools with well trained personnel.

SUMMARY

The embodiments of the present disclosure provide a keyboard assembling method to solve the problems from screwing keyboard parts by connecting materials and parts without a screw.

Firstly, the present disclosure provides a method for assembling keyboard, comprising: disposing a keyboard frame on a keyswitch module, wherein a plurality of keyswitches passes through the plurality of keyswitch holes correspondingly; forming a plurality of connecting parts respectively in the corresponding connecting holes, wherein the connecting part bonds to a surface of the keyboard frame close to a circuit board through a through hole.

Secondly, the present disclosure provides a keyboard comprising a keyswitch module, a keyboard frame, and a plurality of connecting parts. The keyswitch module comprises a baseplate, a circuit board, and a plurality of keyswitch groups. The circuit board is disposed on the baseplate. The plurality of the keyswitch groups is disposed on the circuit board. The baseplate comprises a plurality of connecting holes. The circuit board comprises a plurality of through holes. The plurality of connecting holes respectively corresponds to the plurality of through holes. The keyboard frame is disposed on the keyswitch module, comprising a plurality of keyswitch holes. The plurality of the keyswitch groups is respectively disposed in the corresponding keyswitch holes. The plurality of connecting parts is respectively filled in the corresponding connecting holes, connecting to a surface of the keyboard frame close to the circuit board through the corresponding through holes.

In the embodiments of the present disclosure, the baseplate and the covering plate can be easily assembled by bonding materials without screwing, thus the assembling problems such as poor screwing, stripping, and short circuit caused by loosening screws falling into the computer can be avoided.

It should be understood, however, that this summary may not contain all aspects and embodiments of the present disclosure, that this summary is not meant to be limiting or restrictive in any manner, and that the disclosure as disclosed herein will be understood by one of ordinary skill in the art to encompass obvious improvements and modifications thereto.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

Figure 1:
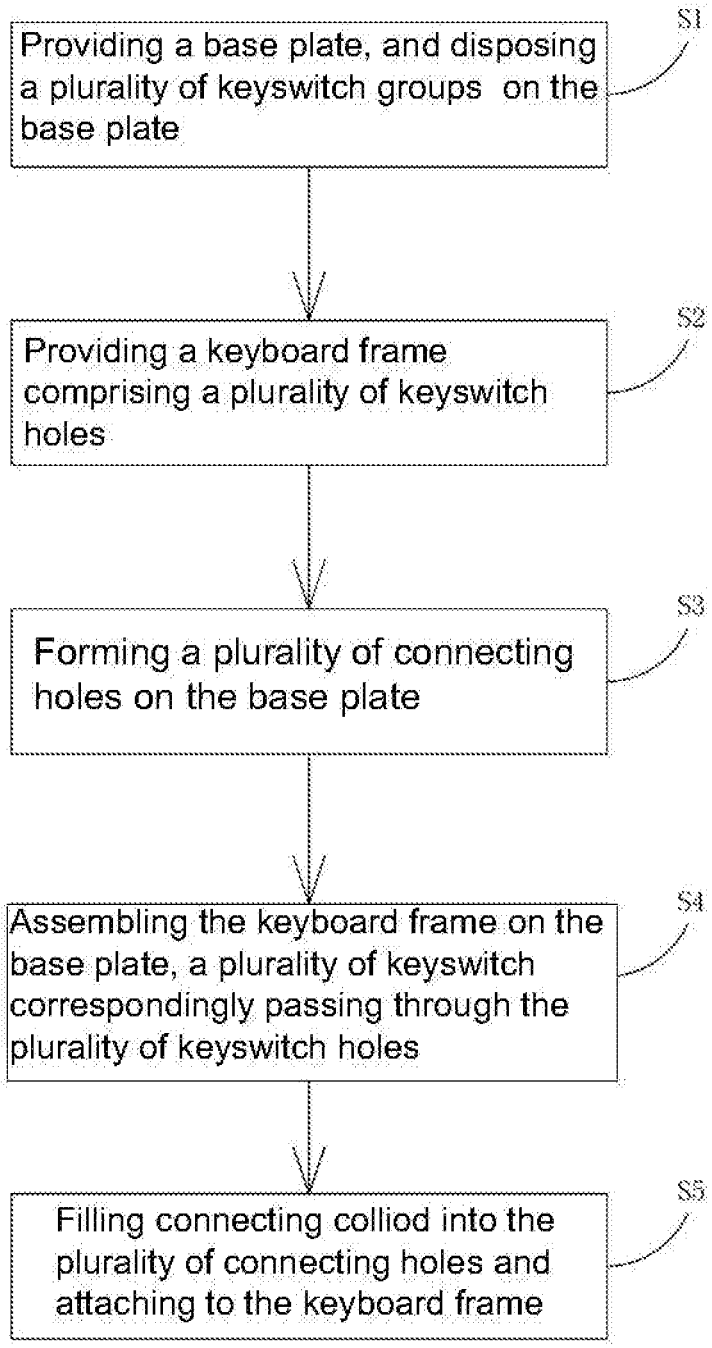
FIG. 1 is a flowchart of a keyboard assembly method of one embodiment of the present disclosure.

The present disclosure will now be described more fully hereinafter with reference to the accompanying drawings, in which exemplary embodiments of the disclosure are shown. This present disclosure may, however, be embodied in many different forms and should not be construed as limited to the embodiments set forth herein. Rather, these embodiments are provided so that this present disclosure will be thorough and complete, and will fully convey the scope of the present disclosure to those skilled in the art.

Certain terms are used throughout the description and following claims to refer to particular components. As one skilled in the art will appreciate, manufacturers may refer to a component by different names. This document does not intend to distinguish between components that differ in name but function. In the following description and in the claims, the terms "include/including" and "comprise/comprising" are used in an open-ended fashion, and thus should be interpreted as "including but not limited to". "Substantial/substantially" means, within an acceptable error range, the person skilled in the art may solve the technical problem in a certain error range to achieve the basic technical effect.

The following description is of the best-contemplated mode of carrying out the disclosure. This description is made for the purpose of illustration of the general principles of the disclosure and should not be taken in a limiting sense. The scope of the disclosure is best determined by reference to the appended claims.

Moreover, the terms "include", "contain", and any variation thereof are intended to cover a non-exclusive inclusion. Therefore, a process, method, object, or device that includes a series of elements not only includes these elements, but also includes other elements not specified expressly, or may include inherent elements of the process, method, object, or device. If no more limitations are made, an element limited by "include a/an" does not exclude other same elements existing in the process, the method, the article, or the device which includes the element.

In the following embodiment, the same reference numerals are used to refer to the same or similar elements throughout the disclosure.

Figure 2:
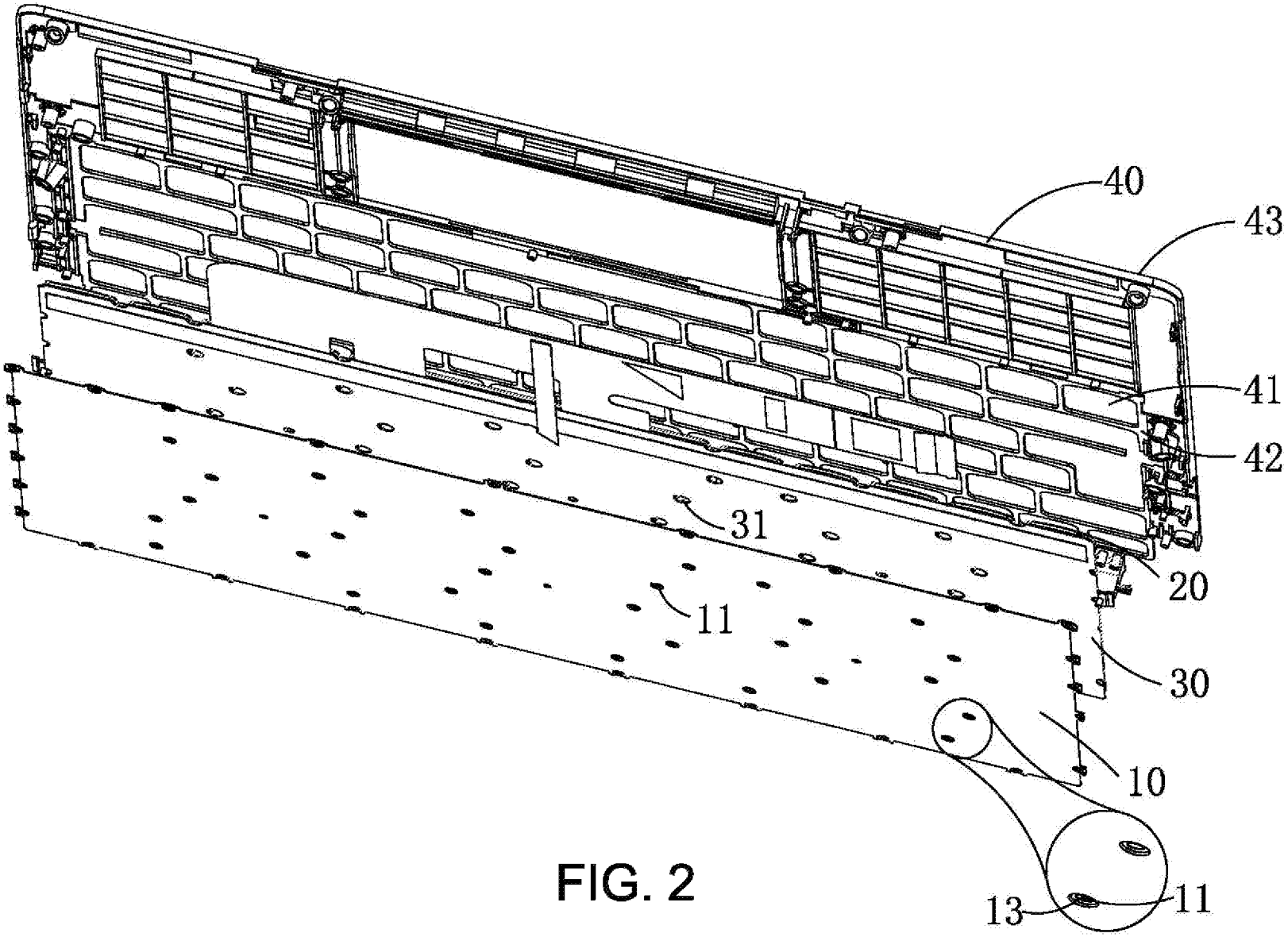
FIG. 2 to FIG. 4 are schematic diagrams of the operation steps of the keyboard assembly method of the first embodiment of the present disclosure.
Figure 3:
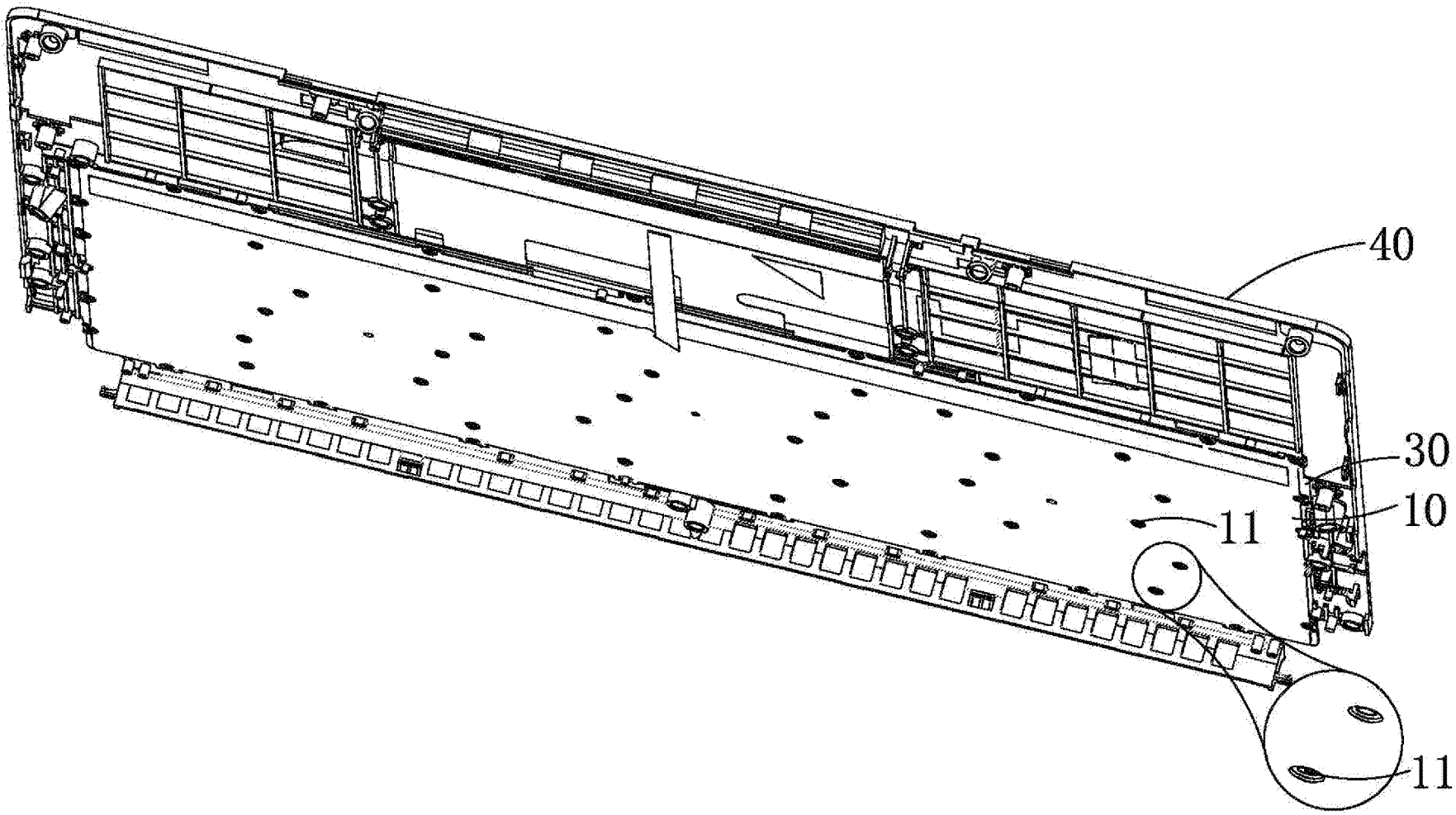
Figure 4:
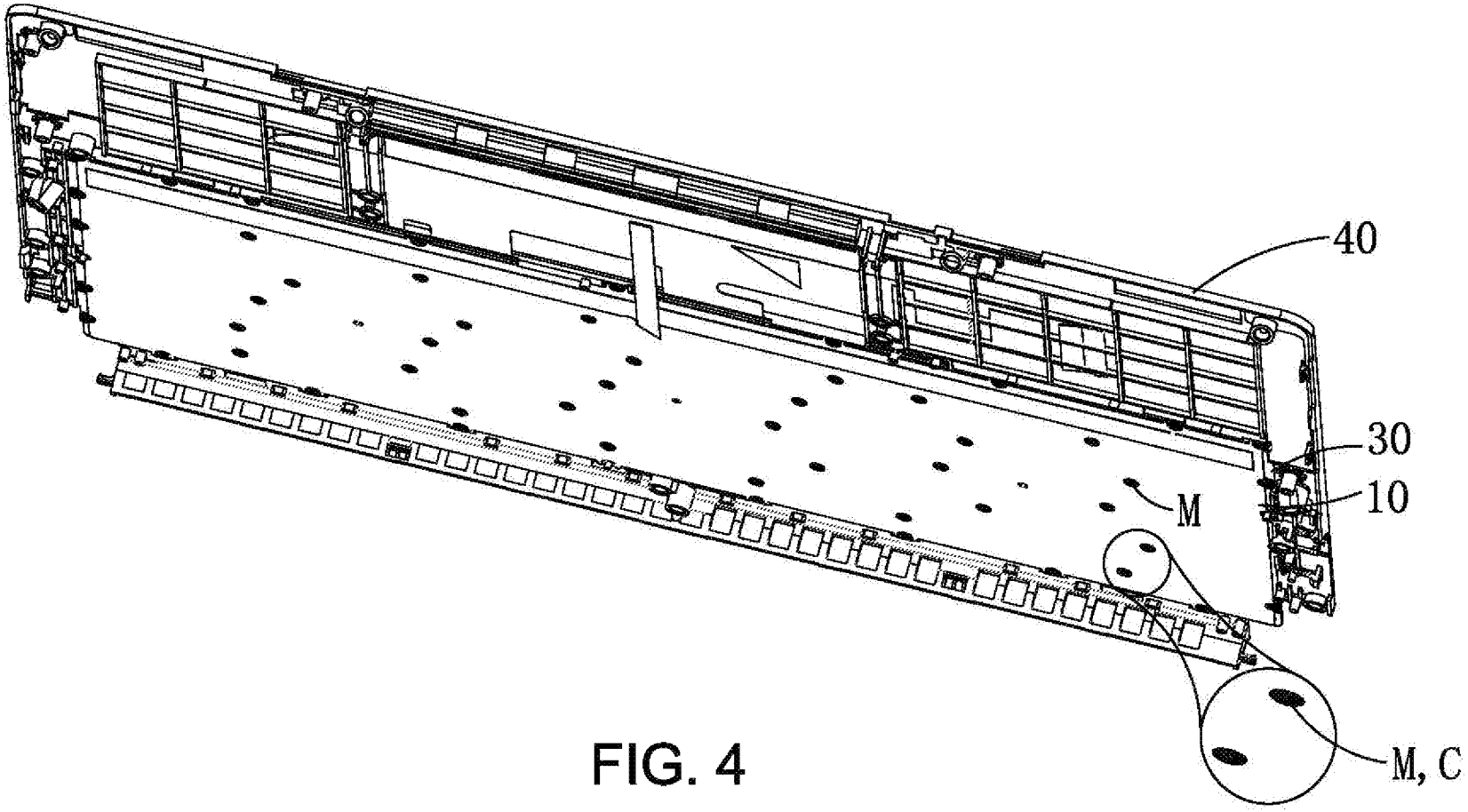

FIG. 1 is a flowchart of a keyboard assembly method of one embodiment of the present disclosure. As shown in the figure, this embodiment provides a keyboard assembling method, which first performs step S1. In step S1, a baseplate 10 is provided, and a plurality of keyswitch groups 20 is provided on the baseplate 10 to form a keyswitch module. FIG. 2 to FIG. 4 are schematic diagrams of the operation steps of the keyboard assembly method of the first embodiment of the present disclosure. As shown in FIG. 2, a baseplate 10 is provided. The baseplate 10 could be a metal plate, such as an iron plate. The plurality of keyswitch groups 20 is disposed on the circuit board 30. The keyswitch group 20 and the circuit board 30 are arranged on the baseplate 10.

Regarding FIG. 1, proceed to step S2 after step S1. In step S2, a keyboard frame 40 is provided. The keyboard frame 40 comprises a plurality of keyswitch holes 41. As shown in FIG. 2, a keyboard frame 40 is provided, and the keyboard frame 40 comprises a plurality of keyswitch holes 41. The keyboard frame 40 may be an injection molded plate on which the plurality of keyswitch holes 41 is formed when inject molding. Each keyswitch hole 41 corresponds to the keyswitch group 20. The keyboard frame 40 comprises a first surface 42 and a second surface 43 opposite to the first surface 42.

Regarding FIG. 1, proceed to step S3 after step S2. In step S3, a plurality of connecting holes 11 is formed on the baseplate 10. As shown in FIG. 2, the baseplate 10 comprises a plurality of connecting holes 11, which could be formed on the baseplate 10 by stamping. The position of the connecting hole 11 corresponds to the first surface 42 of the keyboard frame 40. Since the circuit board 30 is provided on the baseplate 10, and the connecting hole 11 of the baseplate 10 is adapted to be filled with a bonding colloid M described later, a through hole 31 can also be formed correspondingly on the circuit board 30. The through hole 31 of the circuit board 30 corresponds to the connecting hole 11 of the baseplate 10.

Regarding FIG. 1, proceed to step S4 after step S3. In step S4, the keyboard frame 40 is connected to the baseplate 10, and the plurality of keyswitch groups 20 passes through the plurality of keyswitch holes 41 correspondingly. As shown in FIG. 2 and FIG. 3, the first surface 42 of the keyboard frame 40 faces the baseplate 10 and is crimped on the circuit board 30. The first surface 42 of the keyboard frame 40 is exposed through the through hole 31 of the circuit board 30 and the connecting hole 11 of the baseplate 10.

Regarding FIG. 1, proceed to step S5 after step S4. In step S5, the bonding colloid M is filled into the plurality of connecting holes 11 and attached to the keyboard frame 40. With reference to FIG. 3 and FIG. 4, the bonding colloid M is firstly filled into the connecting hole 11 of the baseplate 10 and the through hole 31 of the circuit board 30 and attached to the first surface 42 of the keyboard frame 40. Then the bonding colloid M is cured or hardened and attached to the keyboard frame 40 and the baseplate 10. The cured bonding colloid M respectively forms a plurality of connecting parts C in the corresponding connecting holes 11 of the baseplate 10. The connecting part C is bonded to the surface of the keyboard frame 40 close to the circuit board 30 through the connecting hole 11. With the above description, the assembling of the baseplate 10 and the keyboard frame 40 can be completed. The curing or hardening of the bonding colloid M can be done by illuminating, pressing, or heating. The keyswitch set 20 and the circuit board 30 sandwiched between the baseplate 10 and the keyboard frame 40 also play a role of positioning.

In this embodiment, the step of filling the bonding colloid M into the connecting hole 11 and the following attaching to the keyboard frame 40 comprises the continuous filling the bonding colloid M followed by exposing the bonding colloid M out of the surface of the baseplate 10. The diameter of a part of the bonding colloid M exposed on the surface of the baseplate 10 is greater than the diameter of the connecting hole 11. In this way, after the bonding colloid M is hardened, it forms an enlarged head part outside the connecting hole 11 and is gluing attached to the surface of the baseplate 10.

In this embodiment, at specific positions on two opposite surfaces of the baseplate 10 corresponding to the connecting holes 11, a separating bump 12 is formed on one surface, and a positioning groove 13 is formed on the other surface. In this embodiment, the separating bump 12 is circular, and each connecting hole 11 is circular. The center of each connecting hole 11 coincides with the center of each separating bump 12. The diameter of the through hole 31 of the circuit board 30 is larger than the diameter of the separating bump 12 of the baseplate 10 so that the through hole 31 of the circuit board 30 can be sleeved on the separating bump 12 of the baseplate 10 to play a role of positioning when the circuit board 30 is disposed on the baseplate 10. On the other hand, when filling the bonding colloid M to the first surface 42 of the keyboard frame 40 from the connecting hole 11 of the baseplate 10, the separating bump 12 could separate the bonding colloid M to prevent the bonding colloid M from adhering to the circuit board 30. The separating bump 12 abuts against the first surface 42 of the keyboard frame 40. When the bonding colloid M is filled into the connecting hole 11, the positioning groove 13 on the other surface of the baseplate 10 can also be filled with the bonding colloid M so that the connecting part C formed by curing the bonding colloid M can also be filled into the positioning groove 13. The diameter of the positioning groove 13 is greater than the diameter of the connecting hole 11 so that the bonding colloid M can form an enlarged head part as mentioned above at the outer end of the connecting hole 11 after being hardened.

Figure 5:
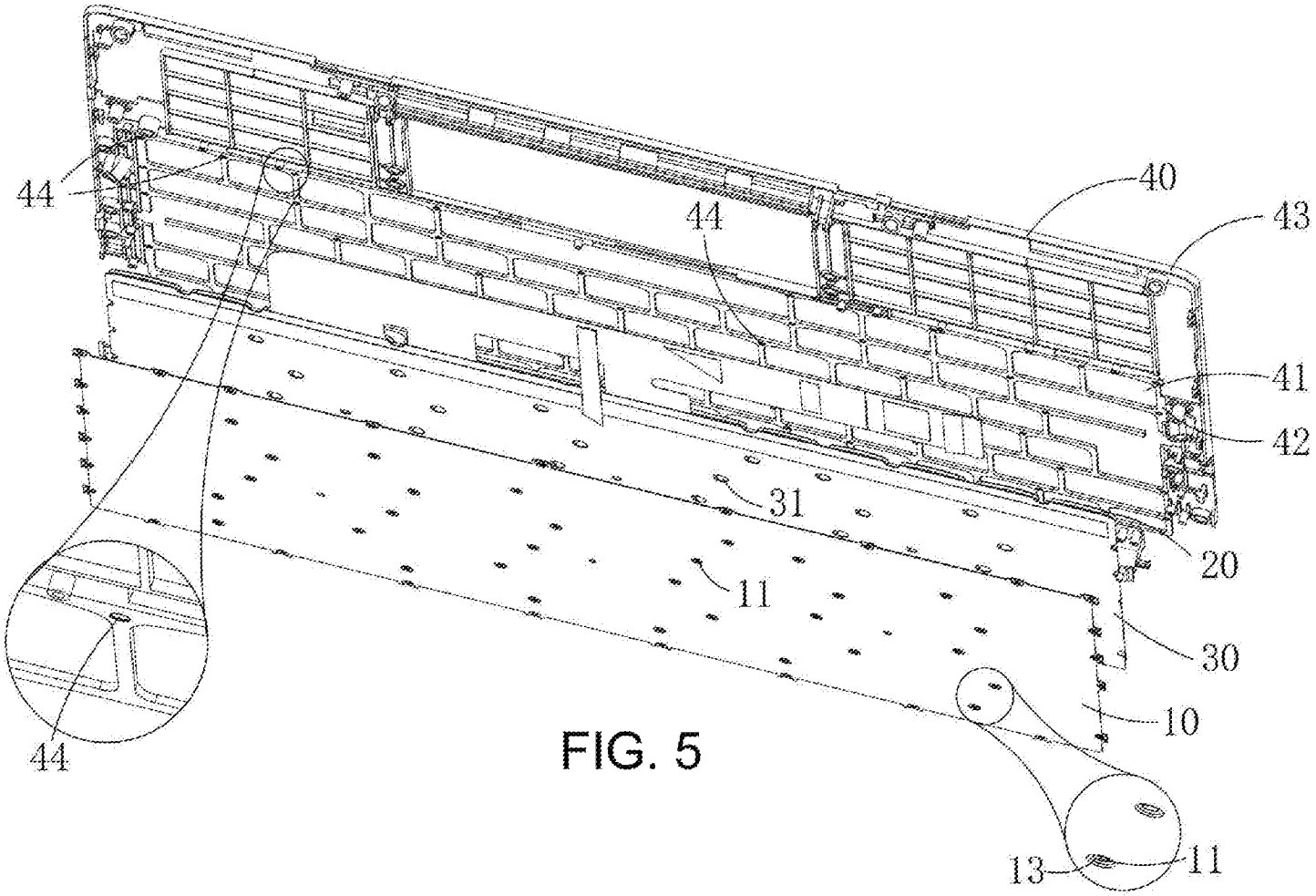
FIG. 5 to FIG. 7 are schematic diagrams of the operation steps of the keyboard assembly method of the second embodiment of the present disclosure.
Figure 6:
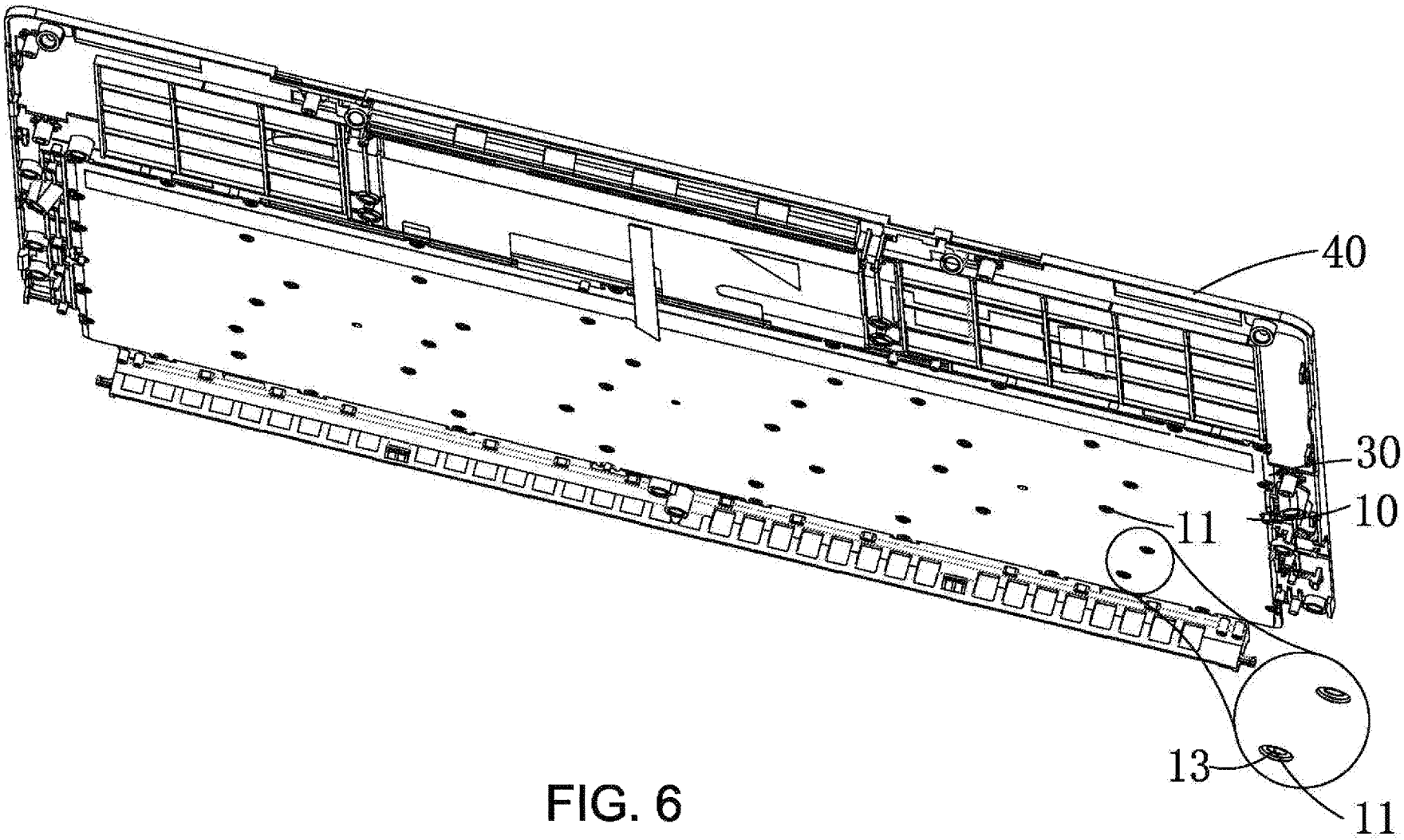
Figure 7:
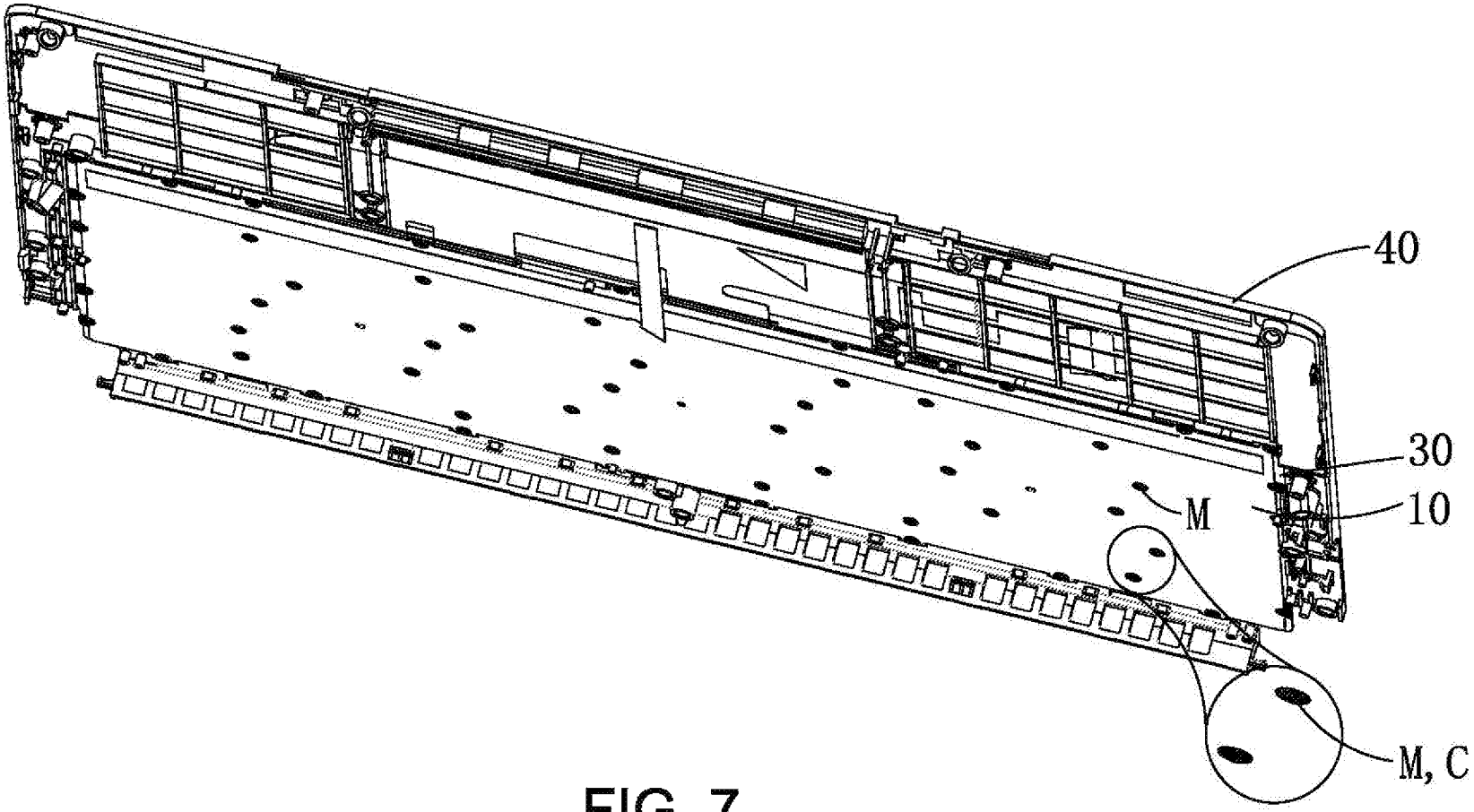

FIG. 5 to FIG. 7 are schematic diagrams of the operation steps of the keyboard assembly method of the second embodiment of the present disclosure. As shown in the figure, the same components as in the first embodiment are given the same symbols and descriptions would be omitted. The difference between this embodiment and the first embodiment is that a connecting groove 44 is formed on the keyboard frame 40, and the position of the connecting groove 44 corresponds to the connecting hole 11. The first surface 42 of the keyboard frame 40 of this embodiment forms a connecting groove 44, which can be formed at the same time when the keyboard frame 40 is injection molded. The step S4 of filling the bonding colloid M into the plurality of connecting holes 11 and attaching the bonding colloid M to the keyboard frame 40 comprises filling the bonding colloid M into the connecting groove 44. The bonding colloid M is cured to form a connecting part C, and each connecting part C fills the corresponding connecting hole 11 and the connecting groove 44.

The diameter of the connecting groove 44 could be identical to, larger, or smaller than the diameter of the connecting hole 11. The depth of the connecting groove 44 can be configured appropriately so that the bonding colloid M filled in the connecting groove 44 could harden to generate sufficient bonding force.

Figure 8:
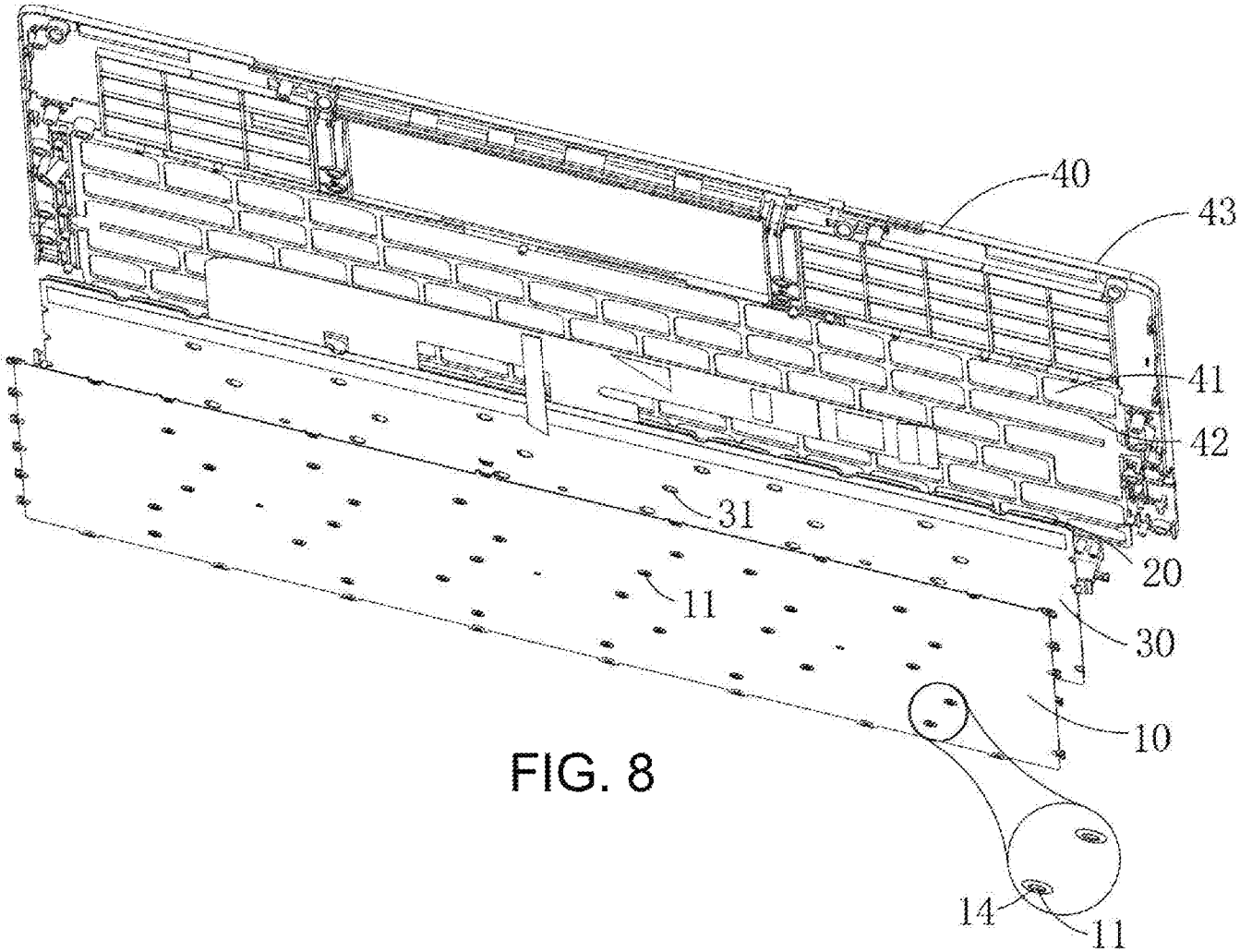
FIG. 8 to FIG. 10 are schematic diagrams of the operation steps of the keyboard assembly method of the third embodiment of the present disclosure.
Figure 9:
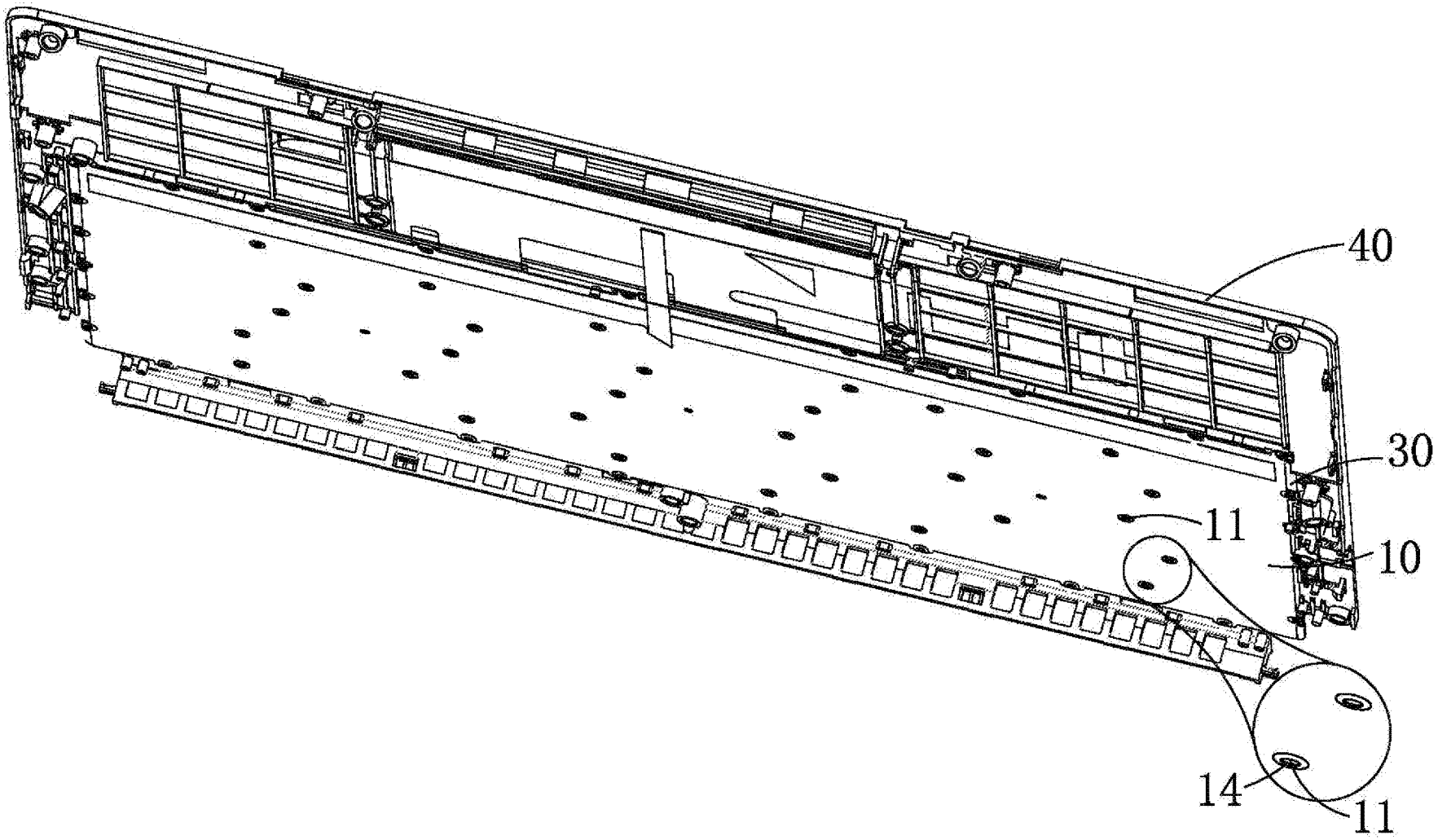
Figure 10:
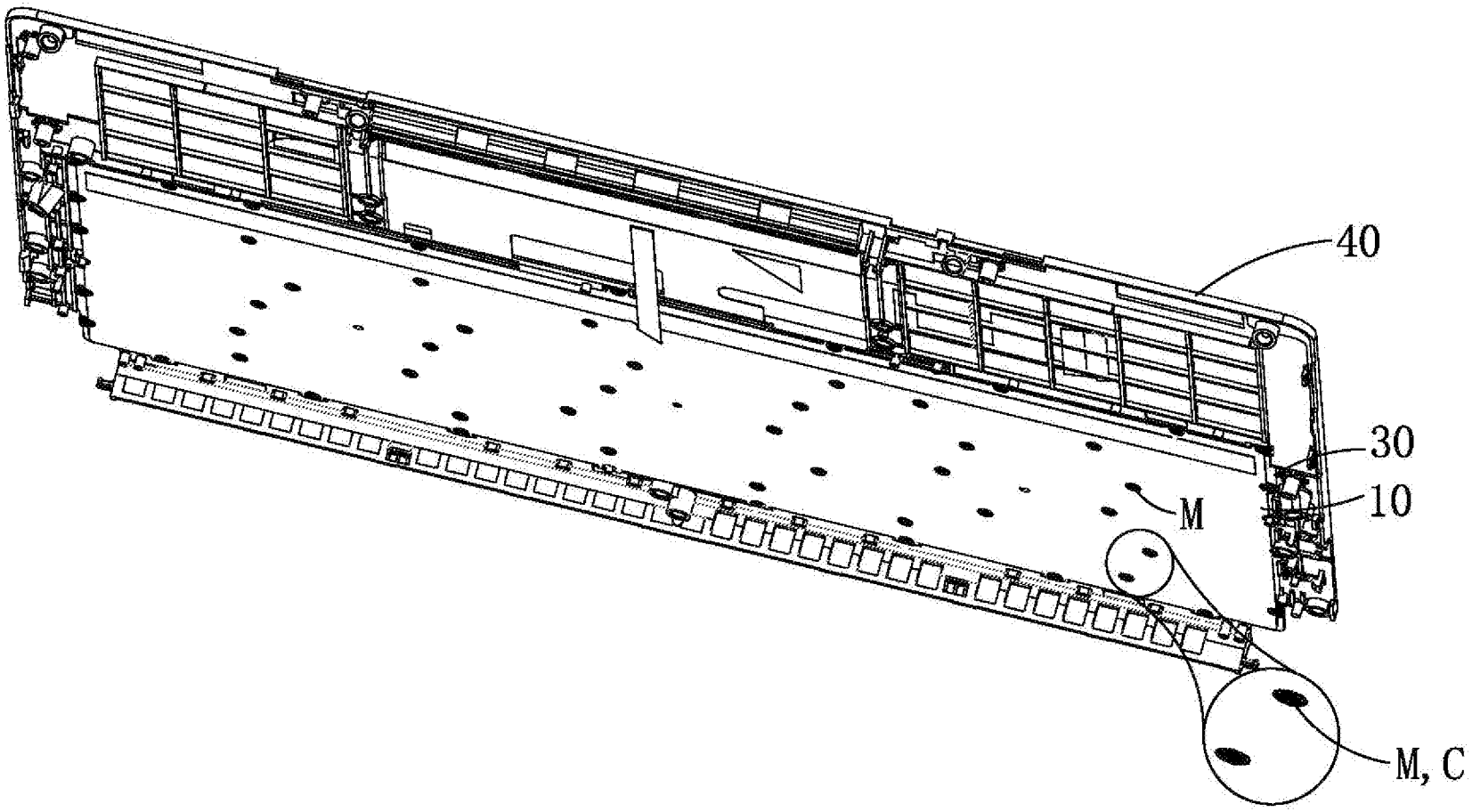

FIG. 8 to FIG. 10 are schematic diagrams of the operation steps of the keyboard assembly method of the third embodiment of the present disclosure. As shown in the figure, the same components as in the first embodiment are given the same symbols and descriptions would be omitted. The difference between this embodiment and the first embodiment is that the two opposite surfaces of the baseplate 10 of this embodiment form an annular bump 14 on one surface and a recess on another surface at a position corresponding to the connecting hole 11. The recess of this embodiment is facing toward the keyboard frame 40, so an accommodating space is formed between the baseplate 10 and the keyboard frame 40. When the bonding colloid M is filled into the connecting hole 11, the bonding colloid M could be partially filled in the foregoing accommodating space in addition to being attached to the first surface 42 of the keyboard frame 40. After the bonding colloid M is hardened, an attachment can be formed on the first surface 42 of the keyboard frame 40, the accommodating space, and the annular bump 14 outside the connecting hole 11 to enhance the bonding force between the baseplate 10 and the keyboard frame 40. In this embodiment, the bonding colloid M forms an enlarged head part at the annular bump 14 outside the connecting hole 11. In addition, in the present embodiment, the annular bump 14 is circular, and each of the connecting holes 11 is circular. The center of the connecting hole 11 coincides with the center of each annular bump 14. The first surface 42 of the keyboard frame 40 of this embodiment may not comprise a connecting groove as in the first embodiment or may comprise a connecting groove 44 as in the second embodiment (as shown in FIG. 5). As shown in FIG. 8 to FIG. 10, the first surface 42 of the keyboard frame 40 of this embodiment does not comprise a connecting groove. Thus, the difference between this embodiment and the second embodiment shown in FIG. 5 is that the baseplate 10 of this embodiment comprises an annular bump 14 and the keyboard frame 40 does not comprise a connecting groove, as the baseplate 10 of the second embodiment comprises a recessive positioning groove 13 and the keyboard frame 40 comprises a connecting groove 44.

Figure 11:
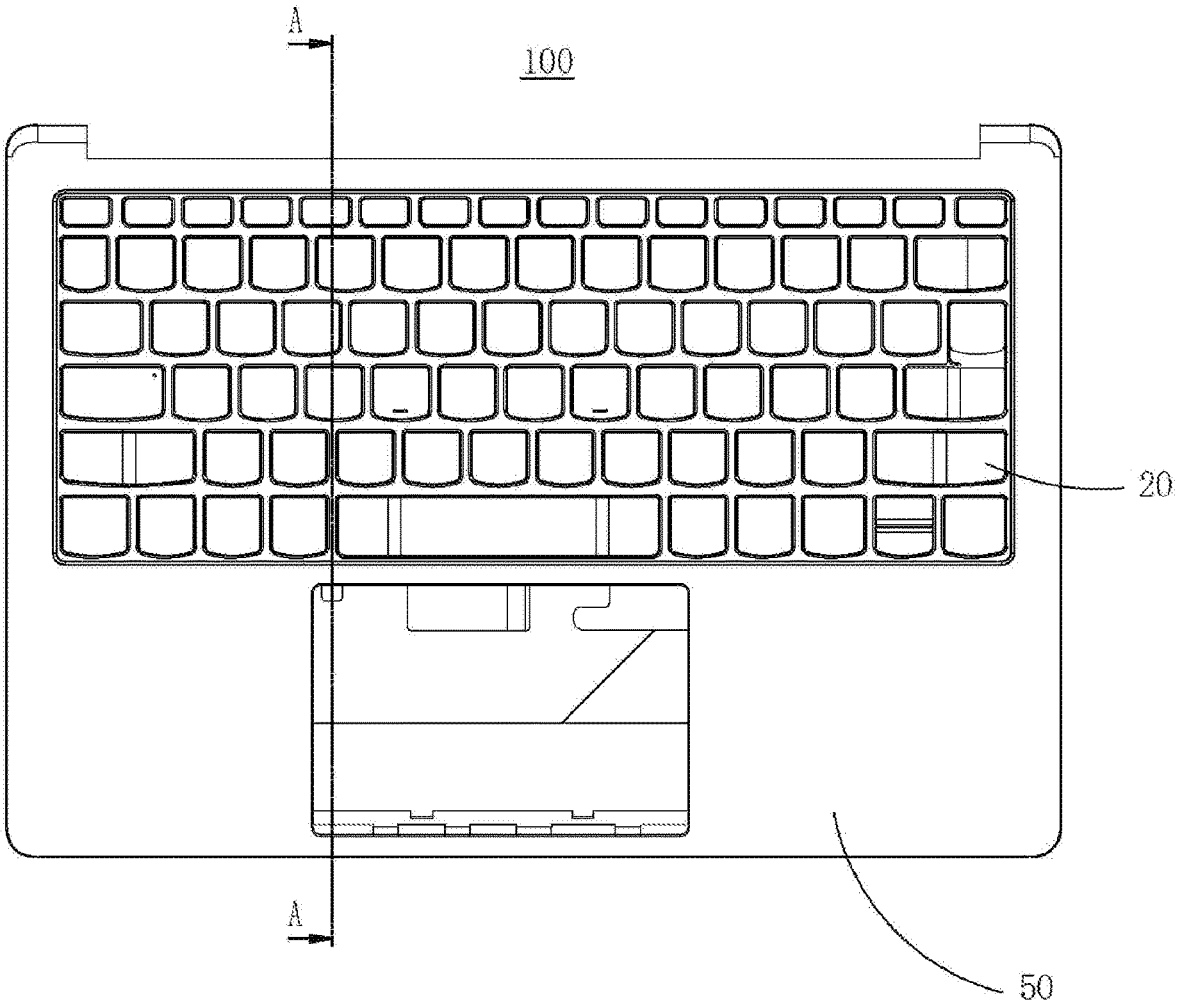
FIG. 11 is a top view of a keyboard assembled by the keyboard assembly method of the present disclosure.
Figure 12:
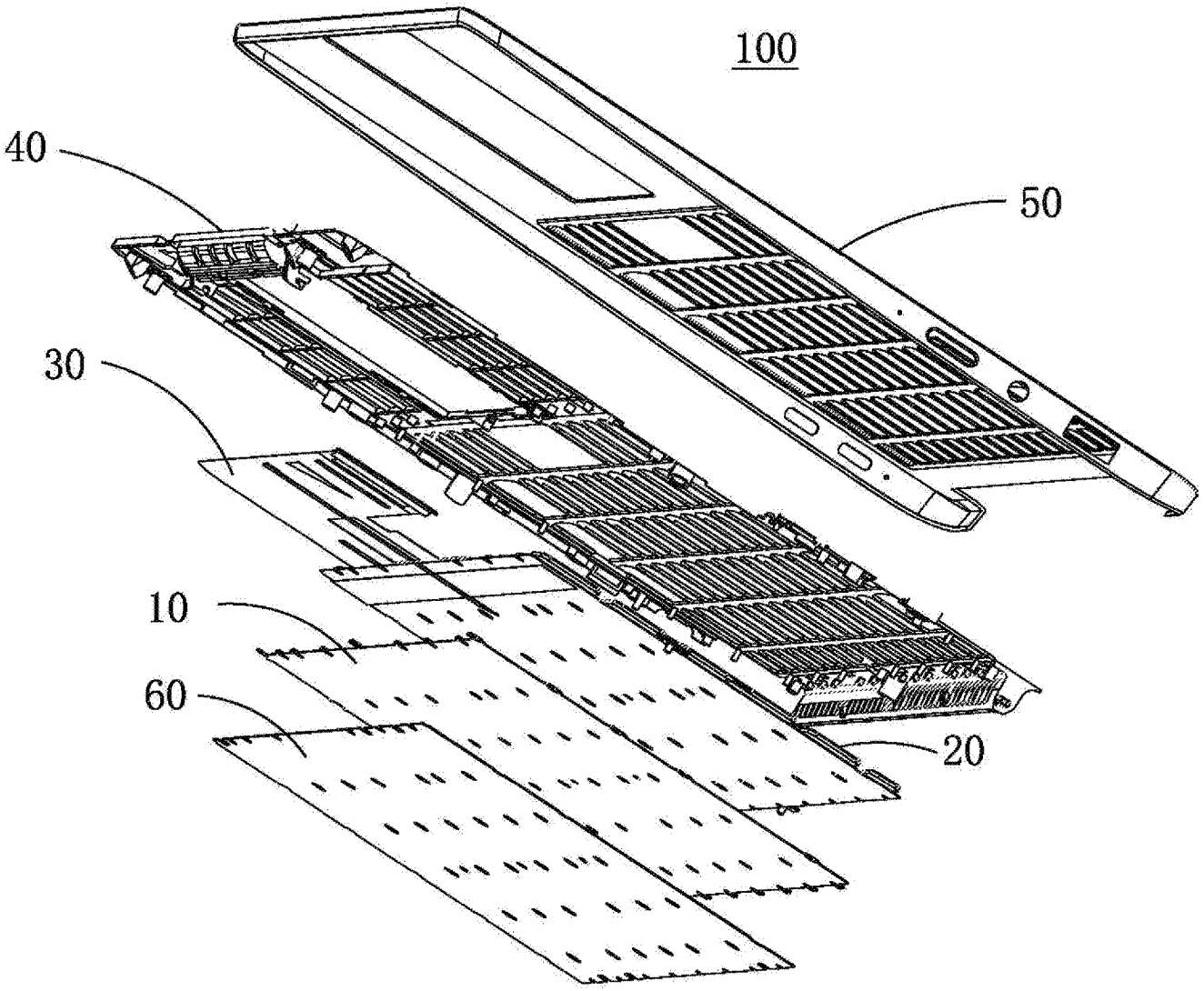
FIG. 12 is an exploded perspective view of the keyboard in FIG. 11.
Figure 13:
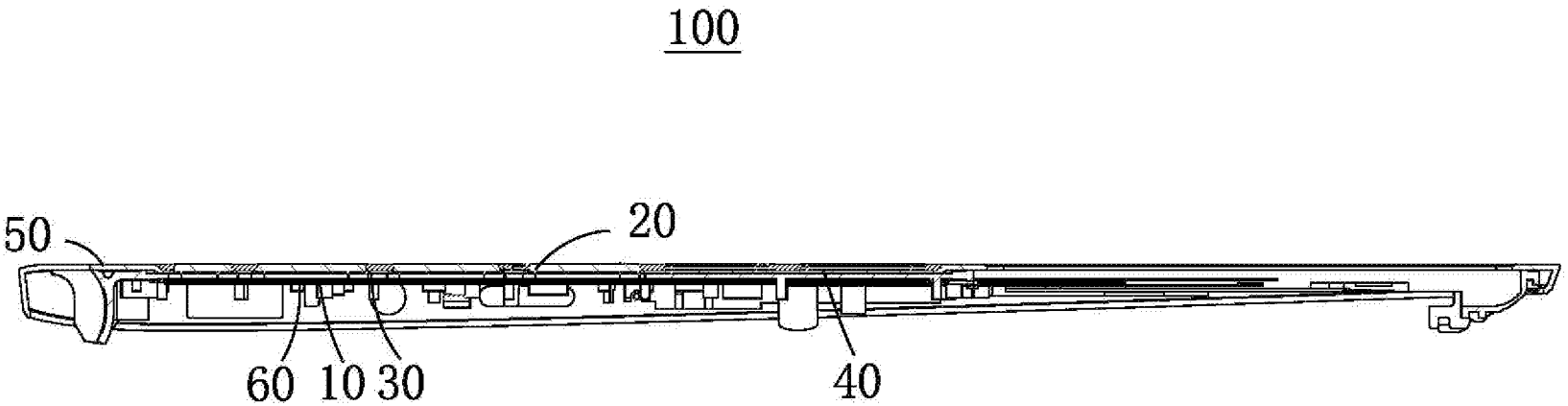
FIG. 13 is a cross sectional view of the keyboard of FIG. 11 along line A-A.
Figure 14:
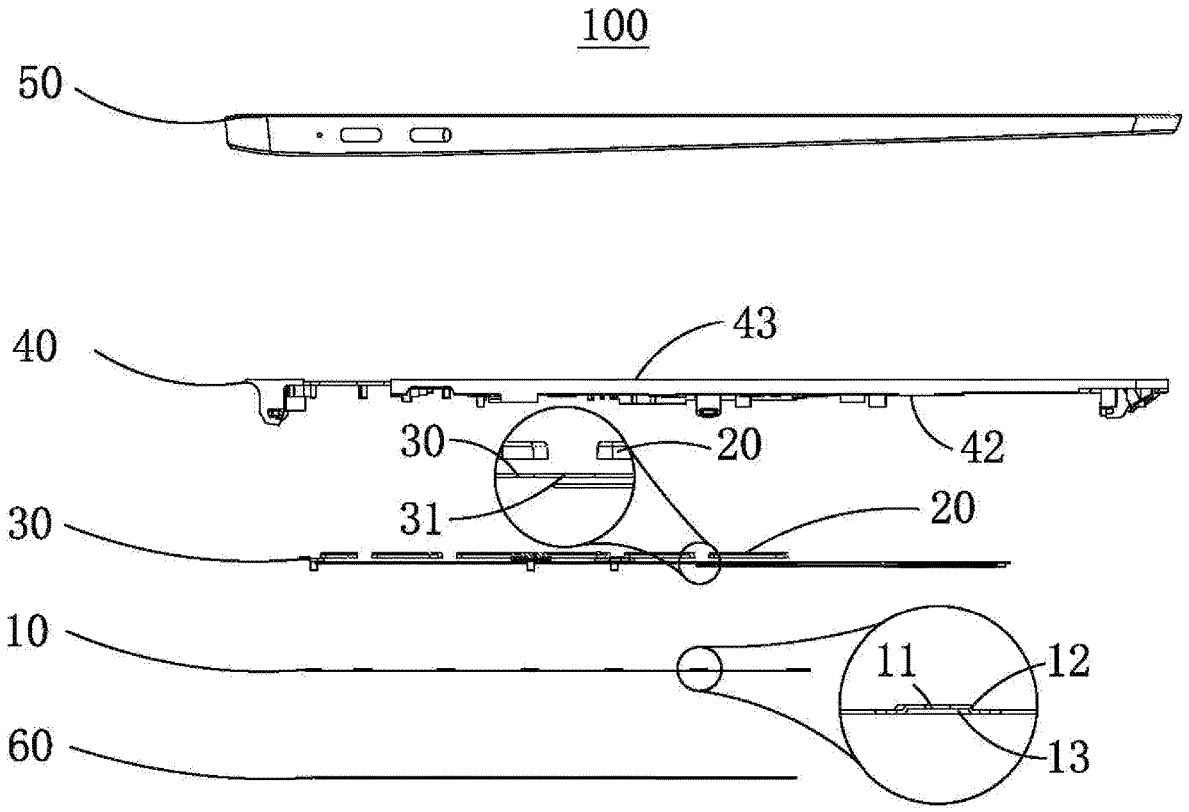
FIG. 14 is a side view of the keyboard in FIG. 12.

FIG. 11 is a top view of a keyboard assembled by the keyboard assembly method of the present disclosure. FIG. 12 is an exploded perspective view of the keyboard in FIG. 11. FIG. 13 is a cross sectional view of the keyboard of FIG. 11. FIG. 14 is a side view of the keyboard in FIG. 12. In addition to the described baseplate 10, keyswitch group 20, circuit board 30, and keyboard frame 40, the keyboard 100 also comprises an outer cover 50 and a protective plate 60. The outer cover 50 covers the second surface 43 of the keyboard frame 40. In this embodiment, the outer cover 50 could also be a frame of a laptop computer (a C part), and the protective plate 60 is disposed on the backside of the baseplate 10.

Figure 15:
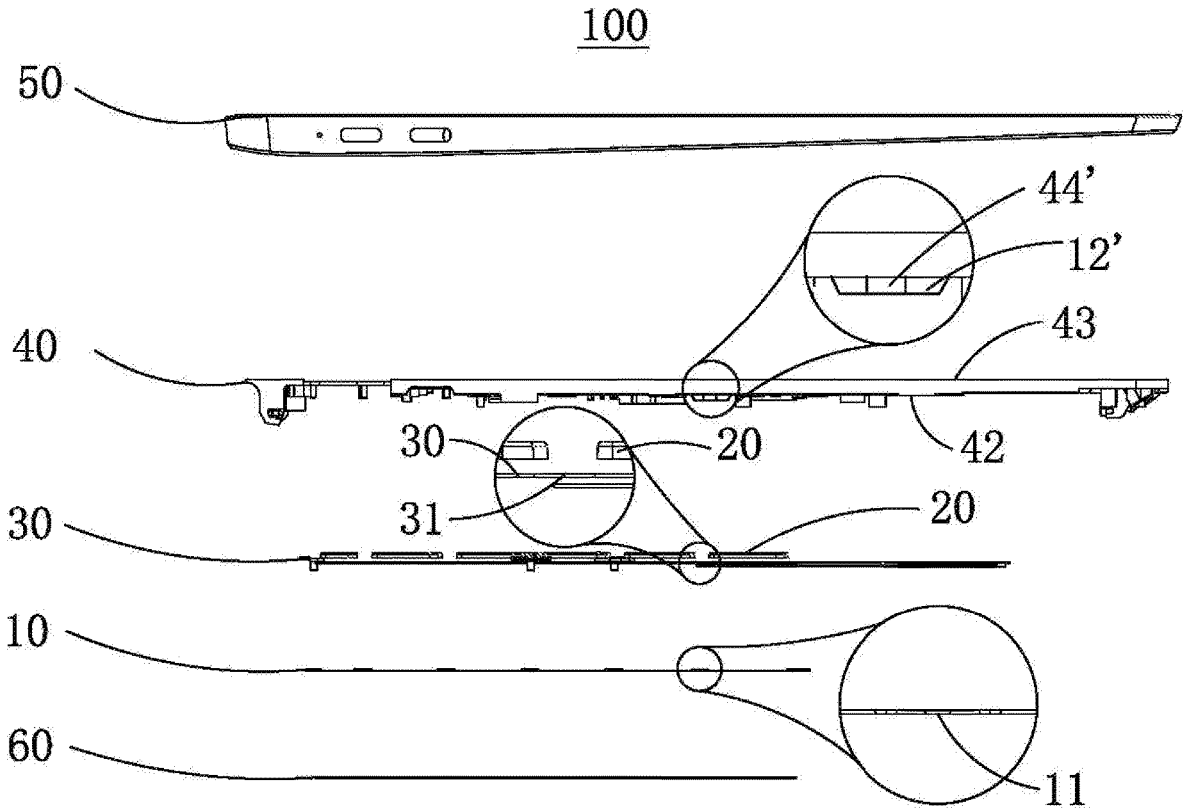
FIG. 15 is an exploded view of a keyboard of another embodiment of the present a disclosure.

In another embodiment, as shown in FIG. 15, the separating bump 12' (second separating bump) may also be disposed on the keyboard frame 40, extending from the first surface 42 of the keyboard frame 40 toward the baseplate 10, and a connecting groove 44' as shown in FIG. 5 is formed in the separating bump 12". The connecting hole 11 on the baseplate 10 corresponds to the connecting groove 44' of the separating bump 12', and the bonding colloid is filled into the connecting hole 11 and the connecting groove 44'. Similarly, the through hole 31 of the circuit board 30 is sleeved on the separating bump 12', which can position and separate the bonding colloid.

Figure 16:
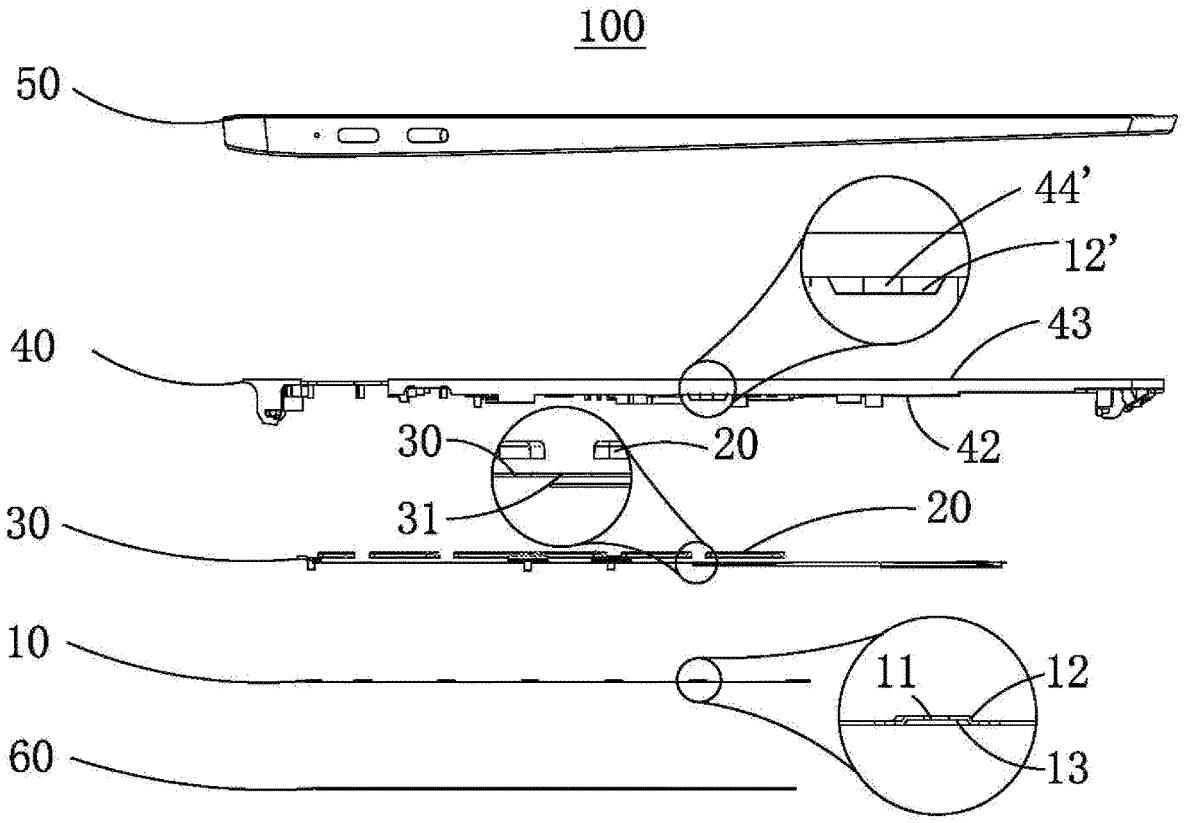
FIG. 16 is an exploded view of a keyboard of another embodiment of the present a disclosure.

In another embodiment, as shown in FIG. 16, the separating bump 12 (first separating bump) and the separating bump 12' (second separating bump) could respectively be disposed on the baseplate 10 and the keyboard frame 40. The separating bump 12 on the baseplate 10 extends to and aligned-assembling with the separating bumps 12' on the keyboard frame 40. A connecting hole 11 is disposed on the separating bump 12 of the baseplate 10. A connecting groove 44' is disposed on the separating bump 12' on the keyboard frame 40. The connecting groove 44' is aligned with the connecting hole 11. The bonding colloid is filled into the connecting hole 11 and the connecting groove 44'. Similarly, the through hole 31 of the circuit board 30 is sleeved on the separating bumps 12 and 12', which can position and separate the bonding colloid.

In summary, embodiments of the present disclosure provide a keyboard assembling method in which the baseplate and the covering plate can be easily assembled by bonding materials without screwing, thus the assembling problems such as poor screwing, stripping, and short circuit caused by loosening screws falling into the computer can be avoided. By filling the connecting groove of the keyboard frame and the accommodating space between the keyboard frame and the baseplate with bonding colloid, and by the forming of the enlarged head part on the outside of the baseplate, the bonding force between the baseplate and the keyboard frame can be increased to perform a solid joint effect which is equal to or better than screwing joint.

It is to be understood that the term "comprises", "comprising", or any other variants thereof, is intended to encompass a non-exclusive inclusion, such that a process, method, article, or device of a series of elements not only comprise those elements but also comprises other elements that are not explicitly listed, or elements that are inherent to such a process, method, article, or device. An element defined by the phrase "comprising a . . . " does not exclude the presence of the same element in the process, method, article, or device that comprises the element.

Although the present disclosure has been explained in relation to its preferred embodiment, it does not intend to limit the present disclosure. It will be apparent to those skilled in the art having regard to this present disclosure that other modifications of the exemplary embodiments beyond those embodiments specifically described here may be made without departing from the spirit of the disclosure. Accordingly, such modifications are considered within the scope of the disclosure as limited solely by the appended claims.

What is claimed is:

1. A keyboard, comprising:

a keyswitch module comprising a baseplate, a circuit board, and a plurality of keyswitch groups, the circuit board disposed on the baseplate, the plurality of the keyswitch groups disposed on the circuit board, the baseplate comprising a plurality of connecting holes and a plurality of first separation bumps, the circuit board comprising a plurality of through holes, the plurality of connecting holes respectively corresponding to the plurality of through holes;

a keyboard frame disposed on the keyswitch module, comprising a plurality of keyswitch holes and a plurality of second separation bumps, the plurality of the keyswitch groups respectively disposed in the corresponding keyswitch holes, each of the plurality of second separation bumps corresponding to and abutting against each of the plurality of first separation bumps, a connecting groove disposed on each of the plurality of second separation bumps, the plurality of first separation bumps and the plurality of second separation bumps corresponding to the plurality of through holes;

a plurality of connecting parts respectively filled in the corresponding connecting holes, connecting to a surface of the keyboard frame close to the circuit board through the corresponding through holes.

2. The keyboard according to claim 1, wherein the keyboard frame comprises the plurality of connecting grooves, the plurality of connecting grooves disposed on a surface of the keyboard frame close to the circuit board, corresponding to the plurality of the connecting holes, each of the plurality of connecting parts is filled in the corresponding connecting hole and the connecting groove.

3. The keyboard according to claim 2, wherein the diameter of the connecting groove is equal to the diameter of the connecting hole.

4. The keyboard according to claim 1, wherein a surface of the baseplate away from the circuit board comprises a plurality of positioning grooves, the plurality of the connecting holes is disposed in the corresponding positioning grooves, each of the plurality of connecting parts is filled in the corresponding positioning groove.

5. The keyboard according to claim 4, wherein the diameters of the positioning grooves are greater than the diameters of the connecting holes.

6. The keyboard according to claim 4, wherein the diameters of the through holes are greater than the diameters of the connecting holes, a surface of the baseplate close to the circuit board comprises the plurality of first separation bumps, the plurality of first separation bumps respectively disposed in the corresponding through holes, abutting against a surface of the keyboard frame close to the circuit board, each of the plurality of connecting holes penetrates the corresponding first separation bump.

7. The keyboard according to claim 1, wherein a surface of the keyboard frame close to the circuit board comprises the plurality of second separation bumps respectively disposed in the corresponding through holes, the plurality of second separation bumps abut against a surface of the baseplate close to the circuit board.

8. A method for assembling the keyboard according to claim 1, comprising:

disposing the keyboard frame on the keyswitch module, wherein the plurality of keyswitches passes through the plurality of keyswitch holes correspondingly;

forming the plurality of connecting parts respectively in the corresponding connecting holes, wherein the connecting part bonds to the surface of the keyboard frame close to the circuit board through the through hole.

9. The method according to claim 8, wherein the step of respectively forming the plurality of the connecting parts in the corresponding connecting holes comprises:

filling a bonding colloid into the plurality of connecting holes, the bonding colloid is bonded to the surface of the keyboard frame close to the circuit board through the through hole;

curing the bonding colloid to form the plurality of the connecting parts.

* * * * *